US011231189B2

(12) United States Patent
Klopfenstein et al.

(10) Patent No.: US 11,231,189 B2
(45) Date of Patent: Jan. 25, 2022

(54) UNDER-FLOOR PLIABLE AIR DUCT/DISPERSION SYSTEMS

(71) Applicant: Rite-Hite Holding Corporation, Milwaukee, WI (US)

(72) Inventors: Jeffrey Klopfenstein, Dubuque, IA (US); Kevin J. Gebke, Dubuque, IA (US); Nicolas B. Paschke, Mequon, WI (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 244 days.

(21) Appl. No.: 16/397,692

(22) Filed: Apr. 29, 2019

(65) Prior Publication Data

US 2019/0249890 A1 Aug. 15, 2019

Related U.S. Application Data

(63) Continuation of application No. 12/196,999, filed on Aug. 22, 2008, now Pat. No. 10,274,216.

(51) Int. Cl.

| | |
|---|---|
| ***F24F 7/10*** | (2006.01) |
| ***F24F 13/02*** | (2006.01) |
| ***F24F 13/06*** | (2006.01) |

(52) U.S. Cl.

CPC ..... *F24F 7/10* (2013.01); *F24F 13/0218* (2013.01); *F24F 13/0227* (2013.01); (Continued)

(58) Field of Classification Search

CPC .. F24F 7/10; F24F 13/00; F24F 13/072; F24F 13/0218; F24F 13/0227; F24F 13/0254; (Continued)

(56) References Cited

U.S. PATENT DOCUMENTS

| | | | |
|---|---|---|---|
| 1,597,588 | A | 8/1926 | Fairbanks |
| 2,133,783 | A | 10/1938 | Merrill |

(Continued)

OTHER PUBLICATIONS

United States Patent and Trademark Office, "Notice of Allowance and Fees Due" issued in connection with U.S. Appl. No. 12/196,999, dated Jan. 8, 2019, 8 pages.

(Continued)

*Primary Examiner* — Jessica Yuen

(74) *Attorney, Agent, or Firm* — Hanley, Flight & Zimmerman, LLC

(57) ABSTRACT

An under-floor HVAC system for a building includes a pliable air duct lying upon a subfloor. A matrix of pedestals resting upon and extending upward from the subfloor supports a set of floor panels, which thus creates a plenum between the subfloor and the set of floor panels. The air duct extends through the plenum to convey conditioned air from a supply air duct to a series of registers in the floor panels. The registers disperse the conditioned air to a room or area just above the panels. To help keep the air duct from repeatedly extending, retracting, and otherwise sliding freely along the subfloor in response to changes in air duct pressure, the air duct is held taut by anchoring a distal downstream end of the duct to one or more of the floor-supporting pedestals. Various air duct configurations can be assembled from a predefined assortment of duct components.

21 Claims, 3 Drawing Sheets

(52) U.S. Cl.
CPC .. *F24F 13/0254* (2013.01); *F24F 2013/0608* (2013.01); *Y10T 29/53* (2015.01)

(58) Field of Classification Search
CPC .... F24F 2013/0608; Y10T 29/53; E21F 17/02
USPC ..... 454/186, 306, 187; 62/259.2
See application file for complete search history.

(56) References Cited

U.S. PATENT DOCUMENTS

| | | | |
|---|---|---|---|
| 3,316,680 | A | 5/1967 | Chrastek |
| 3,595,299 | A | 7/1971 | Pullach et al. |
| 3,639,054 | A | 2/1972 | Wally, Jr. |
| 4,030,518 | A | 6/1977 | Wilcox |
| 4,117,697 | A | 10/1978 | Myers et al. |
| 4,161,193 | A | 7/1979 | Freychet et al. |
| 4,425,839 | A | 1/1984 | Stull |
| 4,578,910 | A | 4/1986 | Germeroth et al. |
| 4,671,811 | A | 6/1987 | Cadwell, Jr. et al. |
| 4,773,197 | A | 9/1988 | Sullivan |
| 4,781,515 | A | 11/1988 | Johnson |
| 4,829,882 | A | 5/1989 | Jackson |
| 5,234,374 | A | 8/1993 | Hyzyk et al. |
| 5,240,288 | A | 8/1993 | Inda et al. |
| 5,294,049 | A | 5/1994 | Trunkle et al. |
| 5,316,035 | A | 5/1994 | Collins et al. |
| 5,468,184 | A | 11/1995 | Collier |
| 5,477,649 | A | 12/1995 | Bessert |
| 5,542,223 | A | 8/1996 | Inda et al. |
| 5,655,963 | A | 8/1997 | Paschke et al. |
| 6,280,320 | B1 | 8/2001 | Paschke et al. |
| 6,425,417 | B1 | 7/2002 | Paschke |
| 6,468,054 | B1 | 10/2002 | Anthony et al. |
| 6,524,182 | B2 | 2/2003 | Kilburn et al. |
| 6,558,250 | B1 | 5/2003 | Paschke |
| 7,169,039 | B2 | 1/2007 | Oppedisano et al. |
| 7,238,106 | B2 | 7/2007 | Scott |
| 9,322,561 | B2 | 4/2016 | Ikeda et al. |
| 9,451,730 | B2 | 9/2016 | Gardner |
| 9,758,982 | B2 | 9/2017 | Anderson, Jr. et al. |
| 9,894,809 | B1 | 2/2018 | Springs et al. |
| 10,274,216 | B2 * | 4/2019 | Klopfenstein ..... F24F 13/0254 |
| 2004/0181921 | A1 | 9/2004 | Alles |
| 2007/0074525 | A1 | 4/2007 | Vinson et al. |
| 2010/0048121 | A1 | 2/2010 | Klopfenstein et al. |

OTHER PUBLICATIONS

United States Patent and Trademark Office, "Non-Final Office Action" issued in connection with U.S. Appl. No. 12/196,999, dated Mar. 22, 2018, 23 pages.
United States Patent and Trademark Office, "Non-Final Office Action" issued in connection with U.S. Appl. No. 12/196,999, dated Jun. 30, 2017, 25 pages.
United States Patent and Trademark Office, "Final Office Action" issued in connection with U.S. Appl. No. 12/196,999, dated Feb. 25, 2016, 20 pages.
United States Patent and Trademark Office, "Non-Final Office Action" issued in connection with U.S. Appl. No. 12/196,999, dated Aug. 18, 2011, 18 pages.
United States Patent and Trademark Office, "Non-Final Office Action" issued in connection with U.S. Appl. No. 12/196,999, dated Jul. 31, 2015, 17 pages.
United States Patent and Trademark Office, "Final Office Action" issued in connection with U.S. Appl. No. 12/196,999, dated Jan. 16, 2015, 16 pages.
United States Patent and Trademark Office, "Non-Final Office Action" issued in connection with U.S. Appl. No. 12/196,999, dated Jun. 20, 2014, 14 pages.
United States Patent and Trademark Office, "Final Office Action" issued in connection with U.S. Appl. No. 12/196,999, dated Mar. 16, 2012, 14 pages.
United States Patent and Trademark Office, "Advisory Action" issued in connection with U.S. Appl. No. 12/196,999, dated Jul. 15, 2016, 3 pages.
United States Patent and Trademark Office, "Advisory Action" issued in connection with U.S. Appl. No. 12/196,999, dated Apr. 9, 2015, 3 pages.

* cited by examiner

UNDER-FLOOR PLIABLE AIR DUCT/DISPERSION SYSTEMS

RELATED APPLICATIONS

This patent arises from a continuation of U.S. patent application Ser. No. 12/196,999 (Now U.S. Pat. No. 10,274,216), which was filed on Aug. 22, 2008, and which is hereby incorporated herein by reference in its entirety.

FIELD OF THE DISCLOSURE

This patent generally pertains to HVAC systems (heating, ventilating and air conditioning systems) and, more specifically, to under-floor air ducts.

BACKGROUND

To heat, cool, filter, dehumidify, ventilate or otherwise condition the indoor air of a comfort zone, such as a room or area in a building, the floor of some buildings have a supply air plenum between a subfloor and a matrix of floor panels that are elevated about one or two feet just above the subfloor. The floor panels, which are usually supported by a matrix of pedestals extending upward from the subfloor, provide the surface upon which the building occupants walk and furniture is set.

With an under-floor HVAC system, a supply air duct discharges fresh or conditioned supply air into the plenum, which in turn conveys the supply air to a series of supply air registers or openings in the floor panels. The registers release the supply air from within the plenum up into the comfort zone. The general goal is to have a sufficient number of properly placed registers such that the supply air rises evenly up through the comfort zone for the benefit of the occupants at floor level. As the supply air continues to rise above the occupants, the eventually used or less-than-fresh air approaches the ceiling to where one or more return air ducts extracts the air for reconditioning and/or exhausting outdoors.

One problem, however, is that if the air from the supply air duct has to travel a great distance to a remote register, the supply air might lose much of its desirable temperature by heat transfer with the subfloor, particularly if the subfloor is made of concrete with a high specific heat. Also, as the supply air travels radially from the supply air duct, the air expands and loses much of its velocity. Additional velocity is lost when less remote registers release air before that air can reach more distant registers. Thus, remote registers receiving lower pressure air tend to release disproportionately less air to the comfort zone than registers that are closer to the supply air duct.

To avoid these problems, some under-floor HVAC systems include a relatively rigid sheet metal air duct or a pliable tubular air duct that is installed under-floor in the plenum between the subfloor and the floor panels. Under-floor air ducts help channel supply air along a more directed route from the supply air duct to certain remote registers. A drawback of such installations, however, is that under-floor air ducts, particularly pliable ones, tend to retract and extend longitudinally in response to changes in duct pressure. The resulting sliding movement can create noise and abrade the duct material. Moreover, there are endless possible floor layouts with various supply airflow needs, thus it can be difficult and expensive to custom build numerous air duct systems to meet all those needs.

DETAILED DESCRIPTION

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity and/or conciseness. Additionally, several examples have been described throughout this specification. Any features from any example may be included with, a replacement for, or otherwise combined with other features from other examples.

Figure 1:
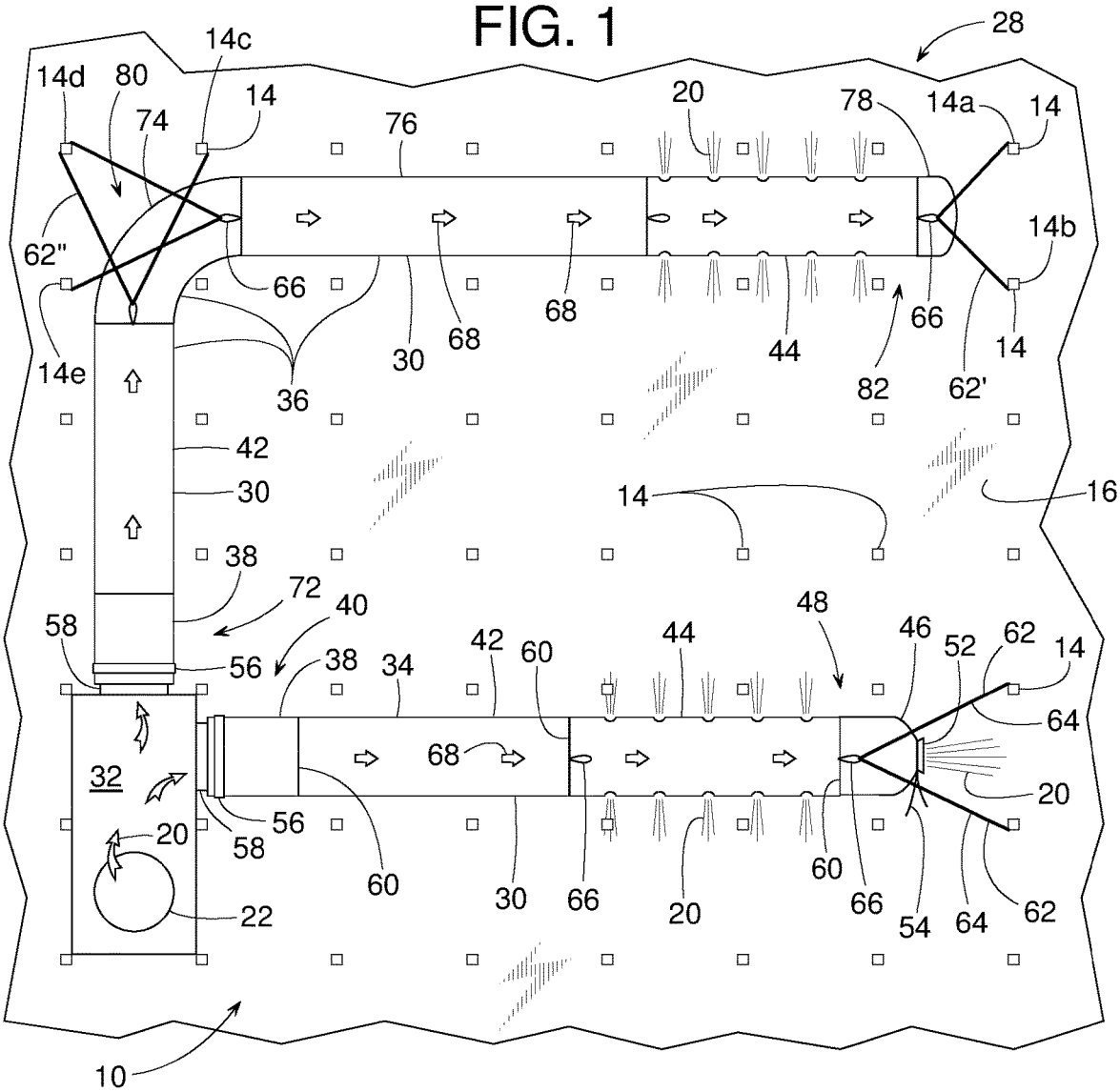
FIG. 1 is a top view of an example of an under-floor air duct system with a plurality of floor panels omitted to show underlying features of the system.
Figure 2:
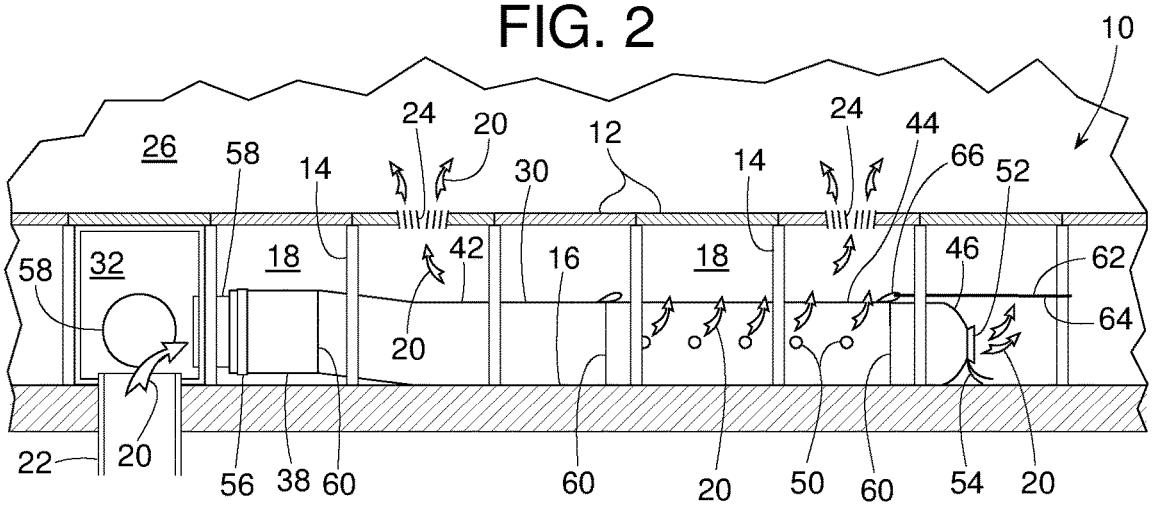
FIG. 2 is a cross sectional view taken along line 2-2 of FIG. 3.
Figure 3:
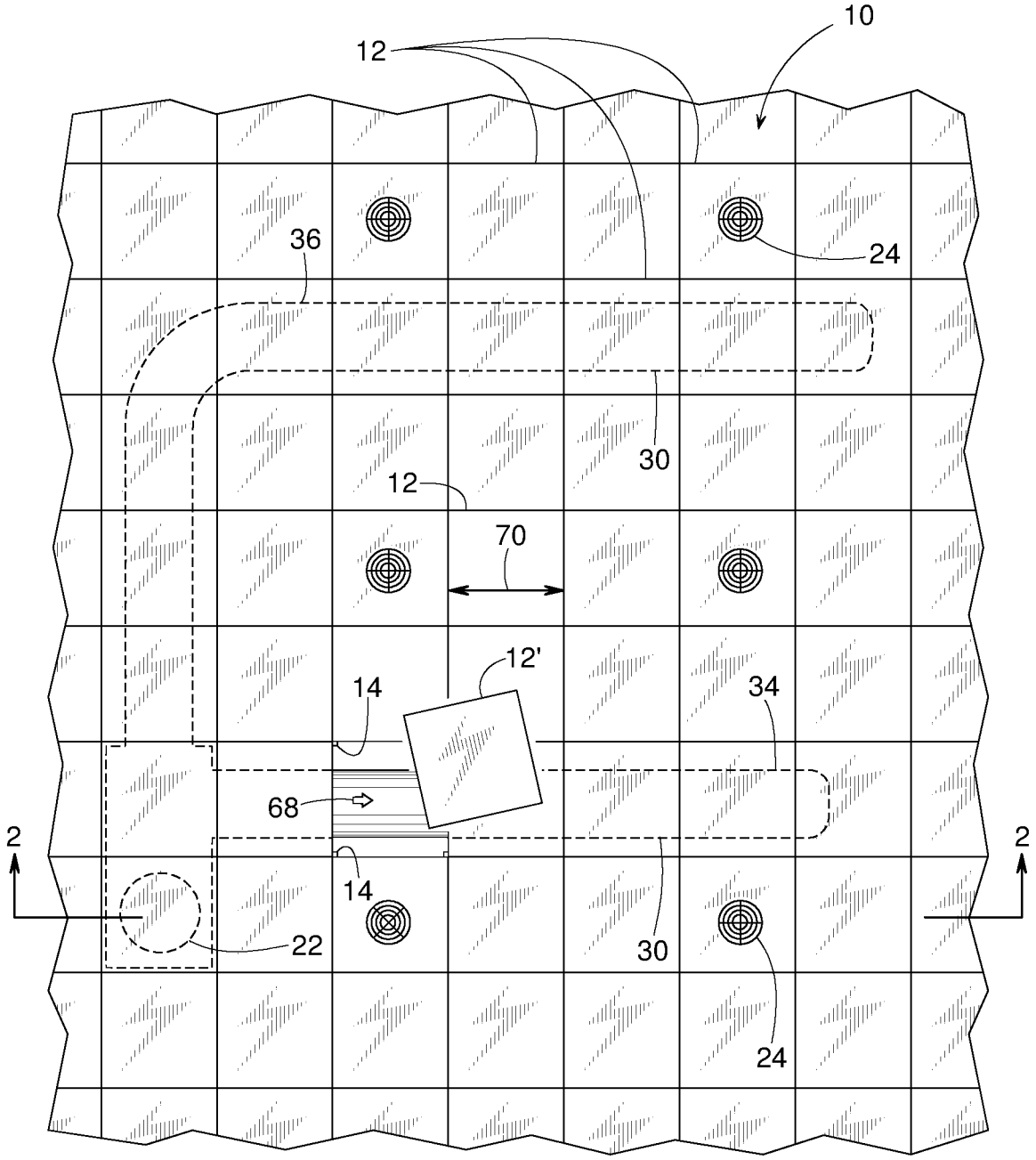
FIG. 3 is a top view similar to FIG. 1 but with most of the floor panels installed.

A building floor 10, shown in FIGS. 1-3, includes a plurality of generally rigid floor panels 12 supported by a matrix of pedestals 14 that extend upward from a subfloor 16. The space between subfloor 16 and floor panels 12 provides a plenum 18 for conveying fresh supply air 20 from a supply air duct 22 to a series of supply air registers 24 in floor panels 12. Supply air 20 discharging upward through air registers 24 helps condition or ventilate a comfort zone 26 that is just above floor panels 12. Comfort zone 26 may be any designated zone supplied with air from a HVAC system, and that may be occupied by people.

To create an air duct system 28 that ensures supply air 20 is evenly distributed or properly apportioned across comfort zone 26, a distribution air duct 30 is installed within plenum 18. Distribution air duct 30 receives supply air 20 from a supply air chamber 32 fed by supply air duct 22 and conveys supply air 20 to wherever it is needed. Distribution air duct 30 is particularly useful for conveying supply air 20 to remote areas of comfort zone 26 that are quite distant from supply air chamber 32.

For sake of example, distribution air duct 30 is shown to include two runs, a straight run 34 and a longer L-shaped run 36; however, any number of runs, shapes or branches of runs are well within the scope of the methods and apparatus described herein. Although the actual construction, assembly and installation of distribution air duct 30 may vary, example runs 34 and 36 are tubes of pliable material, thus distribution air duct 30 generally inflates when pressurized by supply air 20 and tends to collapse (i.e., sag or deflate) when supply air 20 is turned off. The pliable material of distribution air duct 30 can be cloth fabric, sheets of plastic or rubber, porous, nonporous, perforated, nonperforated, and various combinations thereof.

Run 34 of distribution air duct 30 comprises a pliable tubular inlet collar 38 at a proximal end 40 of run 34, a first duct segment 42 that can be porous or nonporous, a second duct segment 44 that is preferably perforated although not necessarily so, and an end cap 46 at a distal end 48 of run 34. To release more supply air 20 near distal end 48, second duct segment 44 includes a series of discharge air perforations 50. First and second duct segments 42 and 44 are examples of an upstream tubular wall section and a downstream tubular wall section, respectively, with first duct segment 42 being more or less air permeable than second duct segment 44. Alternatively, or to release even more supply air 20 near distal end 48, end cap 46 can be provided with a discharge opening 52. The amount of supply air 20 discharged through end cap 46 can be adjusted by tightening or loosening a drawstring 54 at the throat of discharge opening 52. An example of end cap 46 can be found in U.S. Pat. No. 6,558,250.

To assemble run 34, a strap clamp 56 fastens inlet collar 38 to a rigid tubular flange 58 that conveys supply air 20 from supply air chamber 32 to the interior of run 34. To balance or apportion the airflow between runs 34 and 36, a conventional baffle (not shown) can be installed within tubular flange 58. Inlet collar 38, first and second duct segments 42 and 44, and end cap 46 can be joined end-to-end via any suitable fastener 60 including, but not limited to, a zipper running circumferentially around the adjoining pieces. Once assembled, run 34 of distribution air duct 30 can simply rest upon subfloor 16 for vertical support.

For horizontal support, however, or to prevent run 34 from sliding around or repeatedly extending and retracting due to changes in air duct pressure, a fastener 62 preferably connects distal end 48 to one or more pedestals 14. In some examples, fastener 62 comprises an elongate pliable member 64 (e.g., cable, strap, chain, rope, cord, wire, etc.) that connects a loop 66 (e.g., hook, snap connector, etc.) that is sewn or otherwise attached to one end of second duct segment 44. To provide run 34 with horizontal support in two dimensions, elongate pliable member 64 can be attached to two or more pedestals 14 in a generally V-shaped layout as shown in FIG. 1. In the V-shaped layout, fastener 62 can be two individual elongate members or a single elongate member with two legs.

To aid service personnel in maintaining or troubleshooting air duct system 28, distribution air duct 30 preferably includes a series of decals 68 (e.g., label, tag, visual marker, sign, arrowhead, etc.) that are distributed along the upper surface of distribution air duct 30. Decals 68 are best placed at intervals that correspond to the standard dimension of floor panels 12 so that whenever any floor panel 12 above distribution air duct 30 is lifted for service reasons, such as panel 12' of FIG. 3, at least one decal 68 is visible. Two feet is a common standard width 70 for floor panels 12, thus the separation between decals 68 is preferably at most two-foot.

Run 36 is similar in construction to run 34. Run 36 comprises inlet collar 38 at a proximal end 72 of run 36, first duct segment 42, a right-hand tubular elbow 74 made of a pliable material, a relatively long duct segment 76 that can be porous or nonporous, second duct segment 44, and a closed end cap 78. Similar to run 34, strap clamp 56 fastens inlet collar 38 to tubular flange 58, and the various pliable duct segments 42, 44 and 76, inlet collar 38 and elbow 74 can be joined end-to-end by way of zippers.

Run 36 includes a first distal end 80 at elbow 74 and a second distal end 82 at end cap 78. Fastener 62' and loop 66 anchors second distal end 82 to pedestals 14*a* and 14*b*, and fastener 62" anchors elbow 74 to pedestals 14*c*, 14*d* and 14*e*. Fasteners 62' and 62" each can be made of a single elongate member with multiple legs or multiple individual elongate members.

Figure 4:
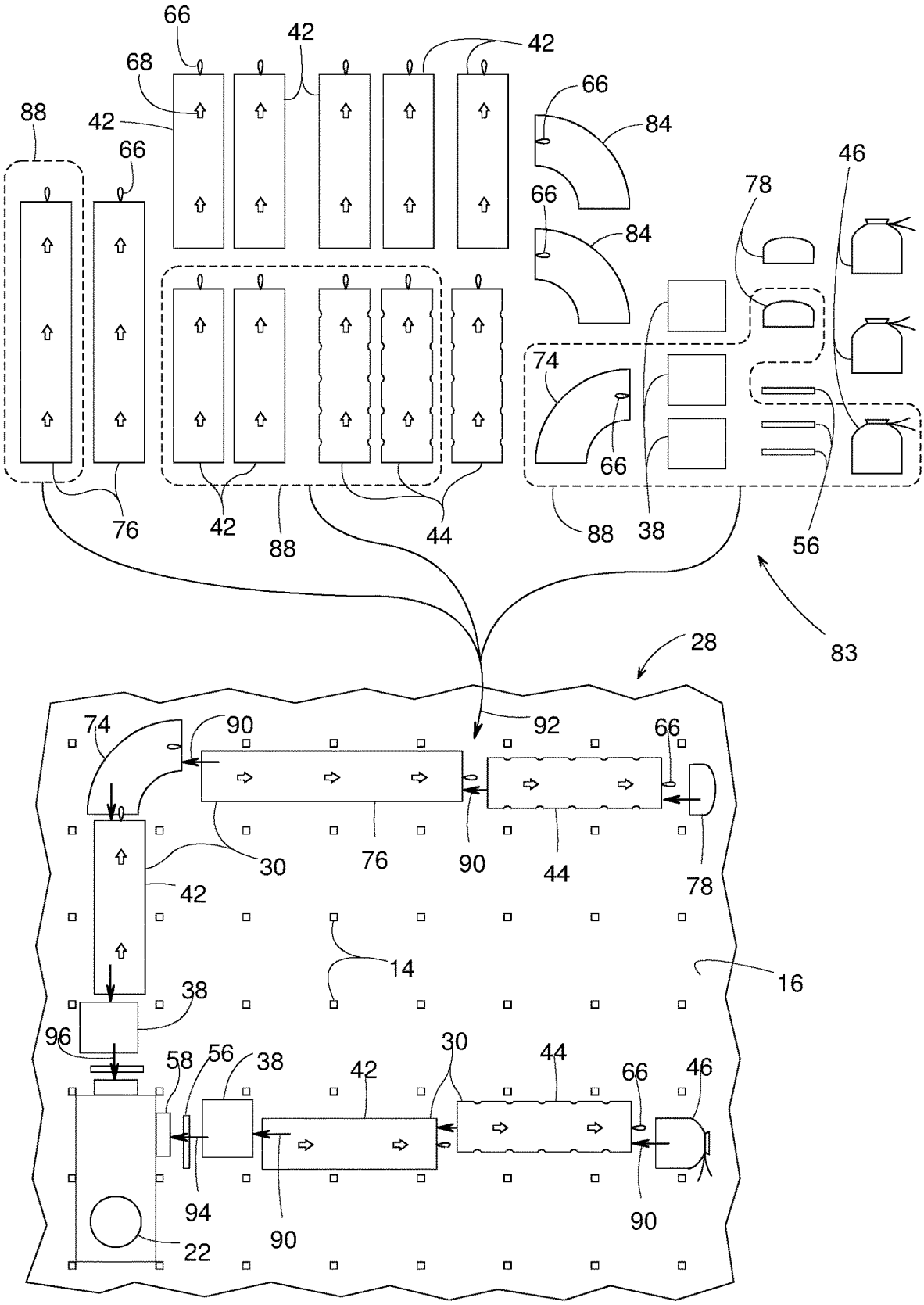
FIG. 4 is an exploded top view illustrating an example of an under-floor method.

Since there are endless possible floor layouts with various supply airflow needs, it can be difficult and expensive to custom build numerous air duct systems to meet all those needs. To address this problem, air duct system 28 preferably is assembled from a predefined assortment of duct segments 83, as shown in FIG. 4. For sake of example, assortment 83 includes two predefined long duct segments 76, seven predefined short first duct segments 42, three predefined second duct segments 44, one right-hand elbow 74, two left-hand elbows 84, three inlet collars 38, two closed end caps 78, three strap clamps 56, and three open end caps 46. The terms "long" and "short" as they relate to duct segments 42 and 76, simply means that one segment of predefined length is longer than the other. It should be noted that right-hand elbow 74 and left-hand elbow 84 are unique and distinguishable from each other by virtue of the location of loop 66 and/or the orientation of their zippered joints.

To create the two-run distribution air duct 30 after defining assortment 83, one strategically chooses a collection 88 of duct segments from assortment 83, wherein collection 88 is depicted by the parts encircled by the dashed lines in FIG. 4. Arrows 90 represents the assembling of collection 88 to create distribution air duct 30, and arrow 92 represents installing of distribution air duct 30. The assembling (arrow 90) of collection 88 and the installing (arrow 92) of air duct 30 do not have to be performed in any particular order. The assembling (arrow 90) of collection 88 and the installing (arrow 92) of air duct 30 can be done in any sequential order or done generally simultaneously. Arrows 94 and 96 each represent coupling proximal ends 40 and 72 to supply air duct 22 such that supply air 20 from supply air duct 22 can pass in series through, for example, proximal end 40, toward distal end 48, out from within distribution air duct 30, into plenum 18, up through supply air register 24 and into comfort zone 26 Once distribution air duct 30 is assembled, fasteners 62 being shown taut in FIGS. 1 and 2 illustrate pulling distribution air duct 30 in tension generally between supply air duct 22 and at least one pedestal 14.

The just-described modular method of assembling a distribution air duct is best achieved when duct segments 42, 44 and 76 are of predefined lengths that are substantially whole number multiples of standard width 70. If, for instance, standard width 70 is two feet, predefined short first duct segment 42 can be two, four, six, eight, . . . 2n feet long. The same is true for predefined long duct segment 76 but with long duct segment 76 being longer than short first duct segment 42.

At least some of the aforementioned examples include one or more features and/or benefits including, but not limited to, the following:

In some examples, an air duct system for a building comprises a collection of pliable tubular segments that are assembled end-to-end to create a distribution air duct that rests upon a subfloor below a plurality of removable floor panels. To help keep the distribution air duct from sliding freely along the subfloor, the air duct is held taut by anchoring a distal downstream end of the duct to at least one and preferable two or three pedestals that help support the floor panels above the subfloor.

In some examples, a distribution air duct is assembled from a collection of pliable tubular segments chosen from a predefined assortment of segments, wherein the assortment of segments are of discrete lengths based upon the width of a standard floor panel.

In some examples, a distribution air duct made of one or more pliable tubes rests directly upon a subfloor, thereby eliminating the need for any overhead mounting support, such as an overhead cable or track.

In some examples, a pliable distribution air duct includes a series of flow direction indicators that are distributed along the length of the duct at a spacing interval that corresponds to the width of a standard floor panel.

In some examples, an under-floor distribution air duct includes an end cap with an adjustable discharge opening.

Although certain example methods, apparatus and articles of manufacture have been described herein, the scope of the coverage of this patent is not limited thereto. On the contrary, this patent covers all methods, apparatus and articles of manufacture fairly falling within the scope of the appended claims either literally or under the doctrine of equivalents.

What is claimed is:

1. An air duct system for conveying air to a comfort zone of a building, wherein the building includes a subfloor, a plurality of pedestals on the subfloor, a plurality of floor panels supported by the plurality of pedestals such that the plurality of floor panels is above the subfloor to define a plenum there between, a supply air duct below the plurality of floor panels, and a supply air register at the plurality of floor panels, the air duct system comprising:

a distribution air duct installable within the plenum underneath the plurality of floor panels, the distribution air duct defined by a circumferentially enclosed tubular wall formed of a unitary pliable material such that the distribution air duct is inflatable and collapsible, a bottom portion of an outer surface of the tubular wall to rest upon the subfloor when the air duct is installed within the plenum, the distribution air duct including a proximal end and a distal end, the proximal end being connectable to the supply air duct such that air from the supply air duct can pass in series through the proximal end, toward the distal end, out from within the distribution air duct, into the plenum, up through the supply air register, and into the comfort zone;

a connector attached to the distribution air duct at the distal end; and a fastener to connect to first and second pedestals of the plurality of pedestals supporting the plurality of floor panels, a first point on the fastener to connect to the first pedestal and a second point on the fastener to connect to the second pedestal, the fastener to extend through the connector at a third point on the fastener when the first and second points are connected to the first and second pedestals, the third point between the first and second points on the fastener such that the fastener is to form a V-shape when connected to the first and second pedestals, the fastener to extend continuously from the first point to the second point, the fastener to be taut, when connected to the first and second pedestals, to tension the distribution air duct in a horizontal direction along a longitudinal axis of the distribution air duct.

2. The air duct system of claim 1, wherein the fastener includes an elongate pliable member.

3. The air duct system of claim 1, wherein the distal end includes an elbow.

4. The air duct system of claim 1, wherein the subfloor is to support the air duct to eliminate positioning the air duct spaced-apart from the subfloor.

5. The air duct system of claim 1, wherein the plurality of pedestals are vertically oriented to extend between the subfloor and the plurality of floor panels, the distribution air duct to rest upon the subfloor in a position laterally separated from the plurality of pedestals.

6. The air duct system of claim 1, further including a second fastener to connect an intermediate point of the distribution air duct between the proximal and distal ends to a third pedestal.

7. The air duct system of claim 6, wherein the intermediate point corresponds to an elbow in the distribution air duct.

8. The air duct system of claim 1, wherein the fastener substantially prevents sliding of the distribution air duct on the subfloor.

9. The air duct system of claim 1, wherein a weight of the distribution air duct is substantially supported by the subfloor.

10. The air duct system of claim 1, wherein the distribution air duct is vertically supported by the subfloor without being vertically supported by a support system connected to an upper portion of the distribution air duct.

11. An air duct system for conveying air to a comfort zone, the air duct system comprising:

a distribution air duct including an elongate duct segment having an entire length extending from a first end to a second end along a straight longitudinal axis, the duct segment including a circumferentially enclosed tubular wall to be disposed within a plenum between a plurality of floor panels and a subfloor below the plurality of floor panels, an outer surface of the tubular wall to be in contact with the subfloor, the tubular wall of the duct segment being made of a pliable material such that the distribution air duct is to be inflatable and collapsible, the distribution air duct including a proximal end and a distal end, the first end of the duct segment to be proximate the proximal end of the distribution air duct, the second end of the duct segment to be proximate the distal end of the distribution air duct, the proximal end to be coupled to a supply air duct within the plenum such that air from the supply air duct passes in series through the proximal end, toward the distal end, out from within the distribution air duct, into the plenum, up through a supply air register, and into the comfort zone;

a connector on the duct segment at the second end to facilitate support of the duct segment, the duct segment devoid of other connectors for supporting the duct segment along the length of the duct segment between the connector and the first end; and a fastener to connect the distal end, via the connector, to a first pedestal of a plurality of pedestals underneath and supporting the plurality of floor panels, the fastener to be taut between the connector and the first pedestal to place the entire length of the duct segment in tension along the longitudinal axis.

12. The air duct system of claim 11, wherein the fastener includes an elongate pliable member.

13. The air duct system of claim 11, wherein the distal end comprises an elbow.

14. The air duct system of claim 11, wherein the fastener is to also connect the distal end to a second pedestal of the plurality of pedestals.

15. The air duct system of claim 14, wherein the first and second pedestals are spaced apart on either side of a line collinear with the longitudinal axis of the duct segment when the distribution air duct is installed within the plenum.

16. The air duct system of claim 15, wherein the first and second pedestals are spaced farther apart than an outer diameter of the duct segment.

17. An underfloor air duct system, comprising:

an air duct segment to be installed between a subfloor and a floor of a building, the air duct segment defining an elongate circumferentially enclosed tubular passageway having an inner surface and an outer surface, the outer surface to be in engagement with the subfloor, the air duct segment including a pliable material to enable the air duct segment to inflate and deflate;

a connector attached to an end of the air duct segment, the connector to extend beyond the end of the air duct segment in a direction toward which the end of the air duct segment faces; and a fastener to be coupled to the connector on the end of the air duct segment, the fastener to extend beyond the end of the air duct segment and beyond the connector to be coupled to first and second pedestals of a plurality of pedestals on the subfloor that support the floor, the fastener to be placed in tension between the first and second pedestals and the connector so as to place the air duct segment in tension along a longitudinal axis of the air duct segment.

18. The underfloor air duct system of claim 17, wherein the fastener is to substantially prevent horizontal movement of the air duct segment while enabling the air duct segment to remain in engagement with the subfloor.

19. The underfloor air duct system of claim 17, wherein the longitudinal axis of the air duct segment is to be positioned substantially perpendicular to a line extending between the first and second pedestals.

20. The underfloor air duct system of claim 17, wherein the air duct segment is to be positioned upon the subfloor to eliminate a support that positions the air duct segment in non-contact with the subfloor.

21. The underfloor air duct system of claim 17, wherein the air duct segment is a first air duct segment, and the connector is a first connector, the underfloor air duct system further including:

an elbow segment defining a curved circumferentially enclosed tubular passageway extending between first and second ends of the elbow segment, the first end of the elbow segment to be attached to the end of the first duct segment; and a second connector attached to the second end of the elbow segment, the second connector to extend in an opposite direction from which the second end of the elbow segment faces.

* * * * *